United States Patent [19]

Northup

[11] 4,020,965

[45] May 3, 1977

[54] CHILD RESISTANT CLOSURE

[76] Inventor: John D. Northup, 2460 Underhill Road, Toledo, Ohio 43615

[22] Filed: May 3, 1976

[21] Appl. No.: 682,775

[52] U.S. Cl. ..... 215/213; 215/214; 215/220

[51] Int. Cl.[2] ..... B65D 55/02; B65D 55/56; A61J 1/00

[58] Field of Search ..... 215/213, 214, 219, 220, 215/301; 220/281

[56] References Cited

UNITED STATES PATENTS

| | | | |
|---|---|---|---|
| 3,912,101 | 10/1975 | Rayner | 215/220 |
| 3,944,102 | 3/1976 | Grau | 215/214 |

*Primary Examiner*—George T. Hall
*Attorney, Agent, or Firm*—Allen Owen

[57] ABSTRACT

A two-piece "push and turn" child resistant closure is disclosed in which an inner cap member has a threaded connection with a vial or bottle which is capable of making a good sealing connection to protect the contents of the container against deterioration. The outer member has a series of protuberances, or a preferably square configuration which greatly improves the utility of the closure for persons having arthritis or other ailments which make it difficult to turn a round closure. Leaf spring operating spring elements are housed in the corners of the protuberances of the outer member.

3 Claims, 14 Drawing Figures

CHILD RESISTANT CLOSURE

BACKGROUND OF THE INVENTION

The Poison Prevention Packaging Act of 1970 has caused a great expansion of the use of child resistant closures on multi-use containers. Obviously, these containers are opened and closed many more times by the user of the contents than by the original packager who usually applies the closure with an application torque which will properly protect the contents. Great difficulty has been encountered by older persons when they try to open child resistant caps on prescription drugs. A survey of 2000 randomly selected pharmacist members of the American Pharmaceutical Association showed that of their customers 84.6 percent found that the problem of opening the containers with great difficulty occurred "often" or "very often". More than half found "often" or "very often", that the customers were unable to open the safety containers without assistance. Some of these people found the difficulty to be so great that they would deliberately break the container and/or the cap and more than half of them would leave the container open or with the safety feature disengaged or would transfer the medicines to another container. Frequently, the contents of the container would be spilled or otherwise lost by the customers while opening a child resistant container.

Many of the medicines packaged in these containers deteriorate upon prolonged exposure to air or moisture and the most common of the child resistant closures makes no attempt to overcome this problem of repeatedly opening and closing a container to form a "tight" seal between the vial in which the medicine is contained and the closure itself. In some forms of medicine a shelf life of 25 days to fifty days is expected when the medicine is in the hands of the pharmacist but this is reduced to two to five days when the same medicine is in a child resistant closure which cannot be tightly closed. It has been recognized that a screw threaded closure is best suited to protect the contents of a container against deterioration. The present invention provides a screw threaded inner member for the child resistant closure which can be tightly closed with a minimum of application torque.

BRIEF DESCRIPTION OF THE INVENTION

The present invention provides a child resistant closure having an inner member which is screw threaded to its closed position on a vial or bottle. The closure has an outer member of such a configuration that it can be easily grasped by the user without resorting to the usual "pinching" action between the thumb and forefinger, but by using essentially his full hand. Conventional leaf springs are provided to hold the inner and outer container elements apart and the force of these leaf springs is readily overcome by a slight downward pushing motion to bring the releasing mechanism into engagement between the inner and outer members.

The points at which the application force is applied by the base of the hand and the fingers of the user is at a greater distance from the center of the cap than is the case with a round cap so that the application and removal torque is more effectively applied. In a tightening direction the torque is applied in such a manner that a "good" or "tight" seal can be accomplished between the inner cap member and the end of the vial as taught in my copending application Ser. No. 666,594. The ratchet members through which the application torque is directed are in recesses created by protuberances on the outer cap member and the force is applied straight through the leaf spring members on a direct tangent to the periphery of the inner cap for the most efficient and direct application of the force to its intended purpose.

The location of the driving leaf springs within the recesses in the corners of the cap also enables the springs to pass over the back of the ratchet lugs on the wall of the inner cap with a minimum of angular deflection thus minimizing any drag between the inner and outer caps when a child attempts to unscrew the closure from the container.

It is well known that children often use their teeth as a gripping device. With child resistant closures consisting of round, flexible plastic inner and outer caps it is relatively easy for a child to bite down on the periphery of the outer cap with sufficient force to cause a frictional engagement between the inner and outer members thus enabling the container to be unscrewed from the closure. In the present invention the use of from two to as many as eight protuberances on the periphery of the outer cap creates a configuration that makes it practically impossible for a child to bite on opposing circular surfaces and to engage the inner cap.

To remove the closure from the container it is necessary to push down on the top and to unscrew simultaneously. This requirement of two simultaneous dissimilar motions is well known as an effective child resistant feature. The requirement of gripping a round cap, however, is the factor that is difficult for arthritic adults (particularly on small diameters) and impossible for many of them.

The springs on the inner and outer members used to keep them apart and then to permit establishment of a driving connection between the members and drive them as a unit when a downward force is applied are well known in the art. This is shown, for example, in Sentman U.S. Pat. No. 2,061,214.

DESCRIPTION OF A PREFERRED EMBODIMENT

Figure 2:
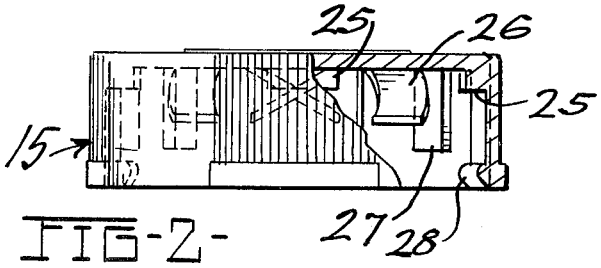
FIG. 2 is a side elevational view of the outer member, with parts broken away.
Figure 5:
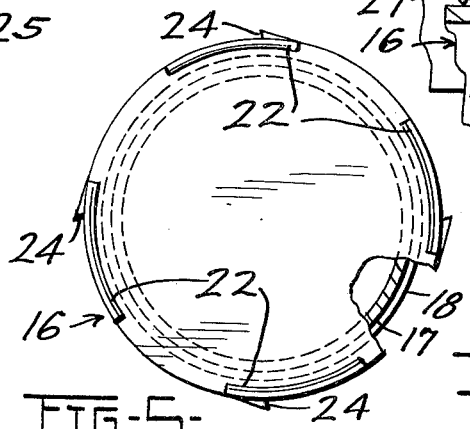
FIG. 5 is a top plan view of a plug type inner member which has threads cooperating with internal threads on the vial.
Figure 3:
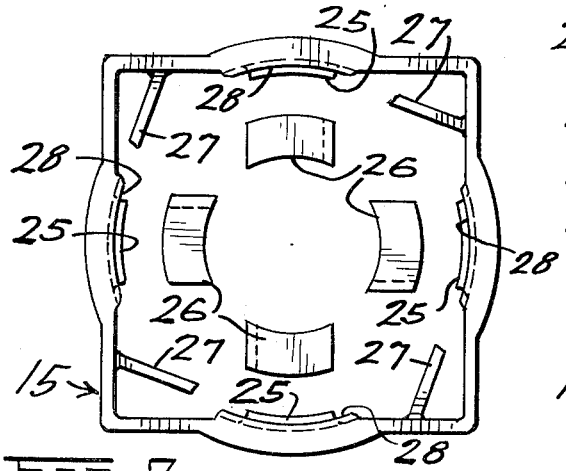
FIG. 3 is a plan view looking upwardly into the outer member.
Figure 6:
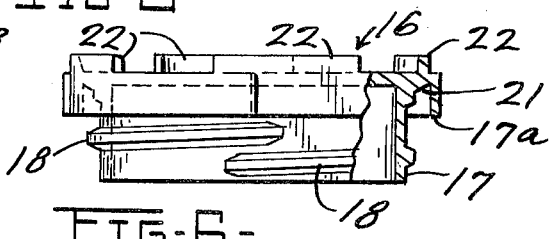

A preferred embodiment of the invention is shown in the drawngs and comprises an outer cap member designated generally 15 and an inner cap member designated generally 16. Each of the cap members has an essentially planar upper surface and depending sidewalls. The outer cap member is shown in detail in FIGS. 2 and 3 while the inner cap member is shown in detail in FIGS. 5 and 6.

The inner cap member, in the form shown in FIGS. 5–9, is a plug type having a depending skirt portion 17 which has threads 18 thereon adapted to engage with mating threads on the interior of the neck portion of a vial or bottle indicated generally at 19.

The finish of the vial or bottle has an angular top surface terminating in an edge 20 of quite small radius. An outer skit 17*a* on the inner cap member is provided which is spaced radially from the threaded skirt member 17. A recess 21 between inner and outer skirt members 17, 17*a* of the inner cap member is shaped congruently to the finish portion 20 of the vial or bottle. Thus, when the inner cap member 16 is driven downwardly by the threaded engagement provided by the threads 18 the finish portion of the vial will make a good or tight seal with the material of the inner cap member.

Figure 8:
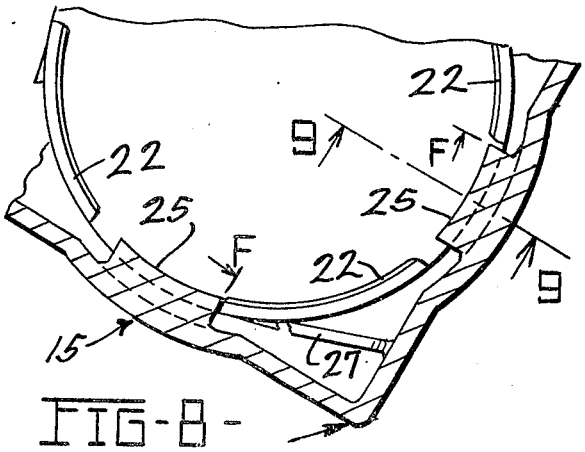

Upwardly extending peripheral drive lugs 22 on the inner cap member provide a conventional removal means. In the form shown in the drawings there are four of the upwardly extending drive lugs and a greater or lesser number may be used if desired. Cooperating drive lugs 25 on the inner surface of the outer cap member cooperate with the peripheral series of drive lugs 22 on the inner cap member to open the closure in a manner well known in the art and as indicated in FIG. 8.

The inner and outer cap members are held apart by a series of separation springs 26 extending downwardly from the lower surfaces of the outer cap members. When it is desired to engage the removal drive mechanism for the inner cap member it is necessary to push downwardly on the outer cap member so that the force of the separation springs is overcome and the driving mechanism between the lugs 22 and 25 may be engaged.

Figure 1:
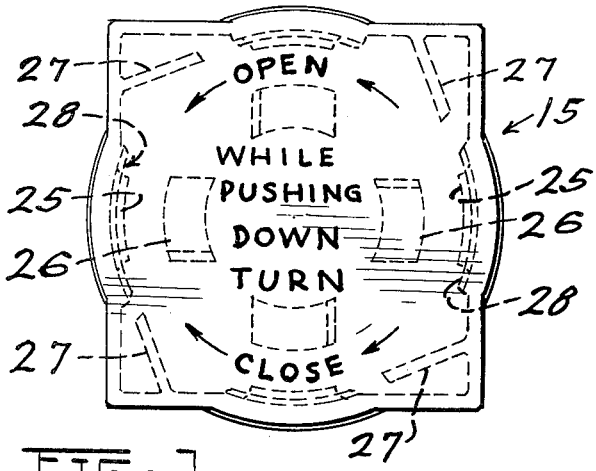
FIG. 1 is a top plan view of an outer member of a complete child resistant closure.
Figure 9:
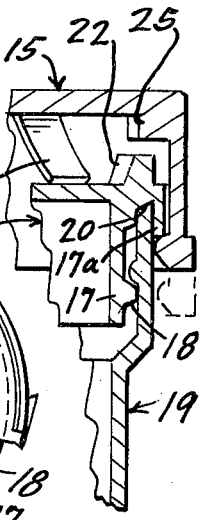
Figure 7:
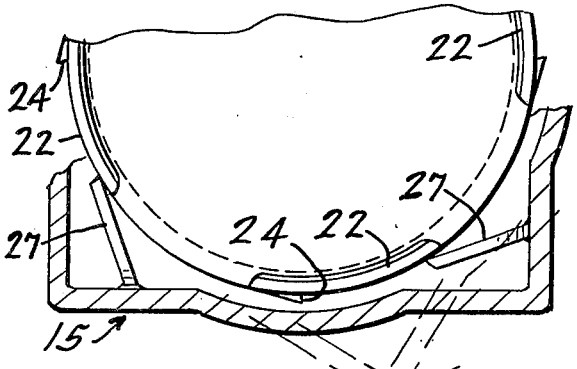
FIGS. 7 and 8 are fragmentary sectional views taken on line 7–8 of FIG. 4.
Figure 10:
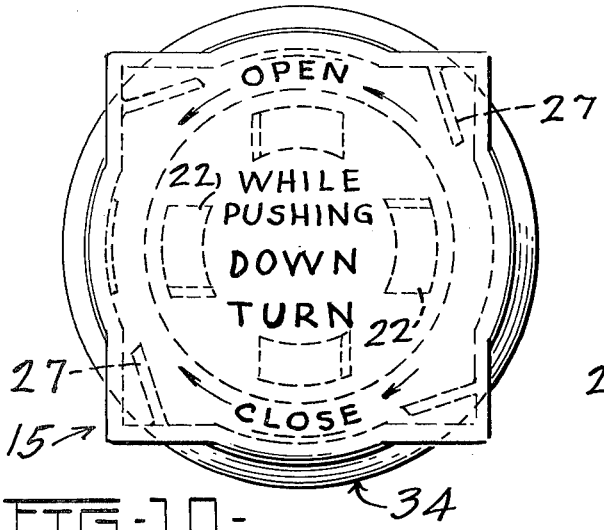
FIG. 10 is a top plan view of a modified form of the invention.
Figure 13:
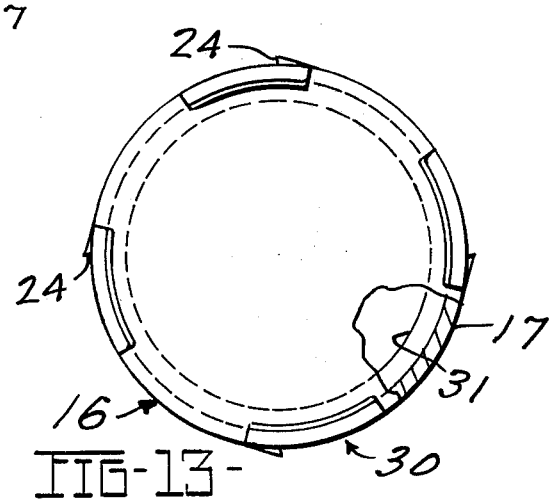
FIG. 13 is a top plan view of an inner cap member of modified form.
Figure 11:
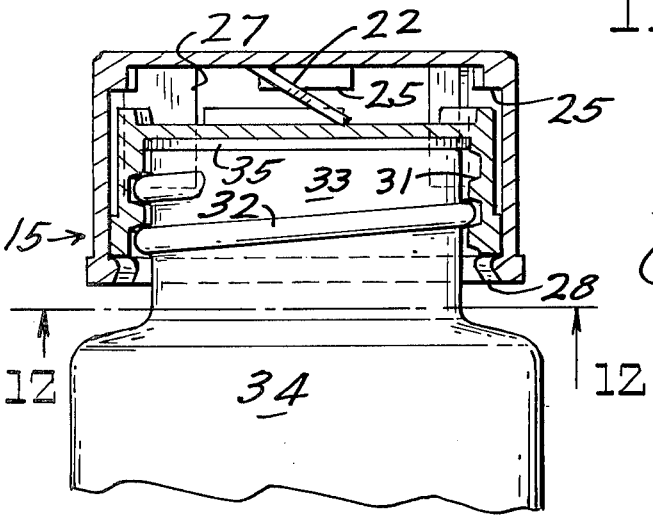
FIG. 11 is a central vertical sectional view of the form of the invention shown in FIG. 10.
Figure 14:
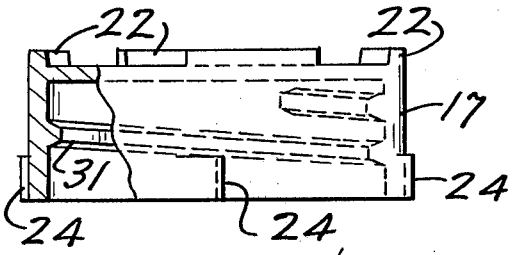
FIG. 14 is a side elevational view, with parts broken away, of the inner cap member shown in FIG. 13.
Figure 12:
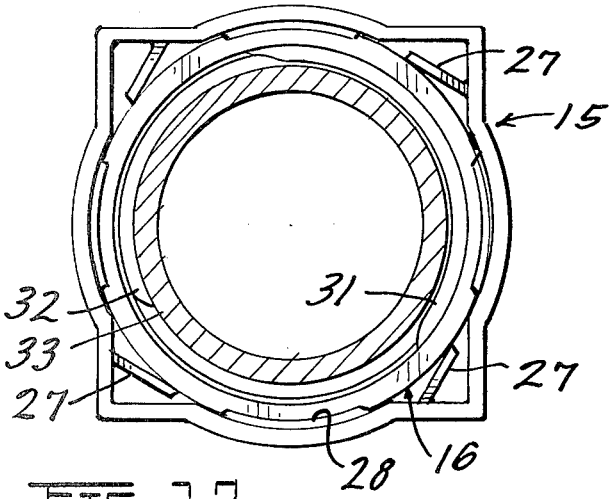
FIG. 12 is a section on line 12—12 of FIG. 11.

The inner cap member is further provided with ratchet teeth 24 on its outer surface. As will be seen in FIGS. 1 and 10 the outer cap member 15 is given a square configuration to provide four corner spaces in which ratchet springs 27 are housed to engage with the ratchet teeth 24 on the sidewall of the inner member. These springs 27 cooperate with the ratchet teeth 24 to screw the inner cap member into place in the neck of the vial or bottle and to bring the sealing surfaces 20 tightly together as indicated in FIGS. 7 and 9. While the present invention shows a square configuration for the outer cap member other configurations such as triangular or hexagonal may be used if desired. It is necessary that the non-round configuration of the outer cap be such that it can be easily gripped by the user, but further, the protuberances used for gripping must be of such size as to be capable of housing the ratchet springs 27 through which the application torque is transmitted to the ratchet teeth 24. For example, two relatively large protuberances could be used if they were contoured properly, because two ratchet springs would suffice to apply the inner cap member.

Figure 4:
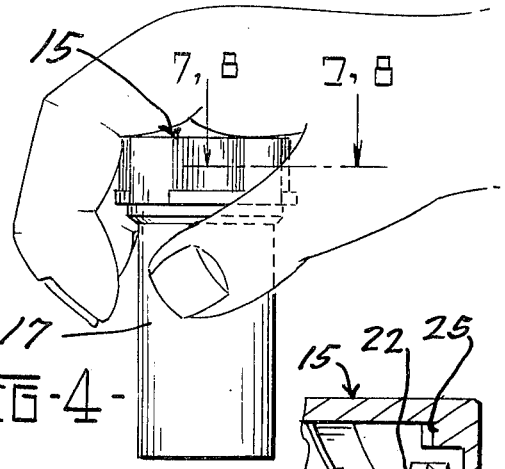
FIG. 4 is a diagrammatic view of a container having a child resistant closure being grasped by the hand of a user.

The polygonal configuration of the outer cap makes it possible for the user to grasp the outer cap member 15 between his fingers and the palm of the hand instead of attempting to pinch the cap member between his thumb and forefinger as is usually the case with round caps. Many arthritic persons are unable to accomplish the pinching action but are fully capable of grasping the closure in the hand as indicated in FIG. 4. Thus the present invention provides a closure that is simpler to remove and replace than those generally known in the art. Further, the sealing surface 20 at the finish of the bottle or vial cooperates with the recess 21 in the inner cap member to provide a seal which can protect the contents of the vial or bottle against deterioration in a manner that is greatly superior to known closures.

A conventional inwardly extending flange or bead 28 holds the inner and outer cap members 15 and 16 against axial separation so that once assembled the outer cap cannot be removed and the inner cap member is functionally contained.

FIGS. 10–14 show the present invention applied to a closure combination in which the inner cap member, here designated 30, has internal threads 31 to engage with threads 32 on the neck portion 33 of a bottle or vial 34. The top of the finish of the neck 33 is made flat and a compressible insert 35 may be introduced under the top surface of the inner closure member to cooperate with the finish of the neck to form a seal which is drawn down or tightened by the threads 31–32.

The application and release elements in this form of the invention are the same as previously described in connection with FIGS. 1–9 and similar reference numerals have been applied. It will be seen that the same square or polygonal shape has been given to the outer cap member 15 so that the closure is easily removable by the same simultaneous downward and twisting motions. As previously noted a greater or lesser number of protuberances may be formed on the outer cap to house the ratchet springs through which the application torque is transmitted and which are easily gripped by the user.

I claim:

1. In a child resistant closure for a container having a threaded finish portion, said closure comprising a round inner cap member having threads engageable with the threads on said container to draw said inner cap member into sealing engagement with the top of said container finish and to release the same, an outer cap member, cooperating means on said inner and outer cap member engageable only upon an axial displacement of said outer cap member to drive said inner cap member in a releasing direction, said outer cap member having a polygonal configuration of six sides or less to define a peripheral series of spaced, hollow protuberances to facilitate gripping by the user, leaf spring driving members housed within the spaces formed by said protuberances between said inner and outer cap members, and ratchet teeth formed on the periphery of said round inner cap member to engage said leaf spring driving members when said outer cap member is turned in a clockwise direction to tighten said inner cap member on said container, said driving members passing over said ratchet teeth when said outer cap member is turned in a clockwise direction.

2. The combination of elements defined in claim 1 in which said inner cap member is provided with external threads cooperating with internal threads on said container.

3. The combination of elements defined in claim 1 in which said inner cap member is provided with internal threads cooperating with external threads on said cap member.

* * * * *